United States Patent [19]

Lynham et al.

[11] Patent Number: 4,524,483

[45] Date of Patent: Jun. 25, 1985

[54] ADJUSTABLE LENGTH FLEXIBLE HANDLE

[76] Inventors: Thomas F. Lynham; Lee J. Curtis, both of c/o MacNeills Warehouse, Newhams Row, 175 Bermondsey St., London, SE1, England

[21] Appl. No.: 572,004

[22] Filed: Jan. 19, 1984

[30] Foreign Application Priority Data

Jan. 20, 1983 [GB] United Kingdom ..... 8301496

[51] Int. Cl.[3] ..... A47B 95/02

[52] U.S. Cl. ..... 16/114 R; 16/125; 16/DIG. 19; 16/DIG. 24; 403/11; 403/17

[58] Field of Search ..... 16/114 R, 115, 119, 16/124, 125, DIG. 12, DIG. 19, DIG. 24, DIG. 40; 403/11, 17

[56] References Cited

U.S. PATENT DOCUMENTS

Re. 22,807 10/1946 Bechik ..... 16/125

2,852,114 9/1958 Heit ..... 16/114 R

FOREIGN PATENT DOCUMENTS 350306 7/1937 Italy ..... 16/125

*Primary Examiner*—Fred A. Silverberg

*Attorney, Agent, or Firm*—Fleit, Jacobson, Cohn & Price

[57] ABSTRACT

An article of furniture comprising a door and/or a drawer which are openable and closeable by a handle, the handle comprising a hollow elongate body made of a flexible material, a pair of end collar members which are a sliding fit one over each end portion of the body, and a pair of screw members for screwing one into each end portion of the body to secure the body to the door or the drawer with the end collar members abutting the door or the drawer, the end collar members being slideable along the entire length of the body so that the body can be cut to any desired length to fit any existing handle holes in the door or the drawer and to have any desired curvature permitted by the flexible material, the end collar members being a sufficiently tight sliding fit that they act to try and prevent outward expansion of the end portions of the body as the screw members are screwed into position in the end portions of the body so that the end portions become firmly sandwiched between the collar members and the screw members, and the body having a bore which is of a size that enables the screw members to bite into the flexible material as the screw members are screwed into position and which is of a uniform size along its length so that the screw members can be screwed into the end portions of the body irrespective of where the body may have been cut without the need for bore enlargement to receive the screw members.

9 Claims, 6 Drawing Figures

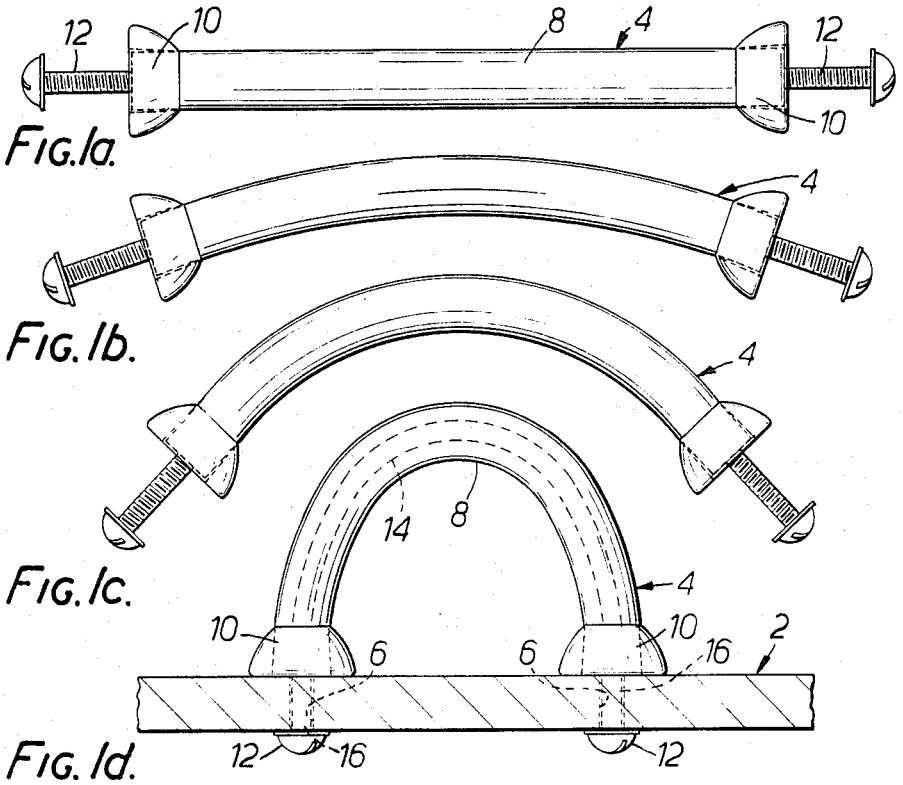
FIG. 1a.
FIG. 1b.
FIG. 1c.
FIG. 1d.
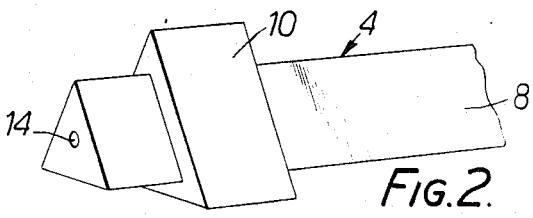
FIG. 2.
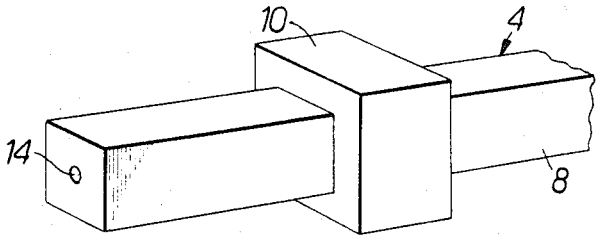
FIG 3

ADJUSTABLE LENGTH FLEXIBLE HANDLE

This invention relates to an article of furniture.

Furniture such for example as wardrobes, cupboards, chests of drawers and cabinets is well known and is presently used in the majority of homes and offices. The furniture must have handles for enabling doors and/or drawers to be opened and closed. Sometimes it is desirable to modernise the furniture or to give the furniture a new look by replacing the existing handles with new ones. Rigid replacement handles are known and these are made in differing sizes to fit the differing distances between which existing screw holes in the doors and drawers of the furniture are spaced apart. Persons replacing handles on their furniture do not wish to incur the trouble of drilling fresh handle holes to take screws for the replacement handles and, with furniture materials such as chipboard, new handle holes cannot be drilled too close to existing handle holes as crumbling of the material occurs and it is then not possible to correctly fit either the new handles or to replace the old handles.

A further problem that exists is that the known rigid replacement handles may not have the curvature actually wanted by the purchaser of the handles. A need exists for furniture handles which permit the purchaser to exercise a degree of personal aesthetic taste in formulating the curvature of the handles when the purchaser is putting them on the furniture.

It is an aim of the present invention to solve the above mentioned problems by providing an article of furniture having a special type of handle.

Accordingly, this invention provides an article of furniture comprising a door and/or a drawer which are openable and closeable by a handle, the handle comprising a hollow elongate body made of a flexible material, a pair of end collar members which are a sliding fit one over each end portion of the body, and a pair of screw members for screwing one into each end portion of the body to secure the body to the door or the drawer with the end collar members abutting the door or the drawer, the end collar members being slideable along the entire length of the body so that the body can be cut to any desired length to fit any existing handle holes in the door or the drawer and to have any desired curvature permitted by the flexible material, the end collar members being a sufficiently tight sliding fit that they act to try and prevent outward expansion of the end portions of the body as the screw members are screwed into position in the end portions of the body so that the end portions become firmly sandwiched between the collar members and the screw members, and the body having a bore which is of a size that enables the screw members to bite into the flexible material as the screw members are screwed into position and which is of a uniform size along its length so that the screw members can be screwed into the end portions of the body irrespective of where the body may have been cut without the need for bore enlargement to receive the screw members.

The article of furniture can be provided with as many differing types of handles as the purchaser cares to buy. New articles of furniture may also be produced with the handles. The manufacture of the new articles of furniture is facilitated by the fact that the handles can be cut to any desired length so that the same basic handle design can be fitted to a variety of articles of furniture. When the handles are in position, the body part of the handle will be substantially rigid and will not deform under normal pressure applied to the handle for opening and closing the doors and/or drawers.

The article of furniture may be a wardrobe, a cupboard, a chest of drawers or a cabinet.

Preferably, the flexible material is a plastics material. Rubber materials may however also be employed. The plastics material may be polythene, polyvinyl chloride or nylon.

The body may be of circular, square, rectangular or triangular cross-section.

Preferably, the body has a smooth outer surface. However, a ribbed or knurled surface may be employed if desired.

Advantageously, the end collar members are provided with a tapered bore with the leading end of the bore being the largest end, the tapered bore facilitating the positioning of the collars over the body of the handle and also facilitating starting of the screwing of the screw members into the bore of the body because the body will not be trapped quite so tightly by the collar members where the collar bore is slightly enlarged.

Preferably, the end collar members are made of a plastics material.

The plastics material may be a resin material. The resin material may be a phenol-formaldehyde resin plastics material.

The end collar members may be made of the same type of material as that of the body of the handle. The end collar members should be made more rigid than the body, for example by being made thicker, in order to prevent the outward expansion of the end portions of the body as the screw members are screwed into position.

The end collar members may be circular, square, rectangular or triangular in plan. The screw members will usually be screws or bolts.

The screw members may be made from plastics materials such for example as the same type of plastics materials as employed for the collar members. Thus the screw members may be made of polythene, polyvinyl chloride or nylon. The screw members may also be made of a metal such for example as aluminium or brass if desired.

The screw members should be made long enough to be able to penetrate through the thickness of the door or drawer. By way of example, it is mentioned that the door or drawer of the furniture may be made of 10 mm or 15 mm chipboard so that the screw length should allow for this thickness of furniture.

The article of furniture may be such that the handle includes a pair of washers, one for each screw member.

The washers may be made of the same material as the screw members.

Plastics materials are preferred for the handle parts because they are light and non-rusting. The handles can thus be used on articles of furniture where moisture is present such as in bathrooms and shower rooms, in addition to being used in other rooms in houses and offices. The plastics materials can also be produced in a variety of colours. Each handle may be such that the body, the collar members and the screw members are all the same colour or different colours. Various colour combinations can be employed. Also, various shape combinations can be employed so that differently shaped collar members can be employed with different bodies.

It is preferred not to pre-thread the bore in the body so that the screw members self-tap as they are screwed into the body because the body is held substantially rigid by the collar members over the end portions of the body. The formed self-tapped screw threads are well defined and they securely fix the handles in position. It is obviously desirable to have the screw members firmly bite into the body since the handles should not become loose during use or during environmental temperature changes where the body may perhaps expand more than the screw members and so tend to loosen the screws in the body were it not for the fact that the collar members will prevent much of the expansion due to temperature changes.

Embodiments of the invention will now be described solely by way of example and with reference to the accompanying drawings in which:

FIGS. 1*a–d* show part of an article of furniture having a first handle shown in various positions; and FIGS. 2 and 3 show parts of second and third handles.

Referring to FIG. 1, there is shown part of an article of furniture in the form of a door 2 provided with a handle 4. The handle 4 is shown straight and in three types of curvature for ease of understanding. Any type of curvature can be employed, as allowed by the material from which the handle 4 is made, to suit aesthetic requirements. Also, the handle 4 can easily be bent to shape so that it can fit to existing handle holes 6 in the door 2.

The handle 4 comprises a hollow elongate body 8 made of a flexible plastics material. A pair of end collar members 10 are also made of a plastics material but they are made to be more rigid than the body 8. The end collar members 10 are a sliding fit as shown one over each end portion of the body 8. The handle 4 also comprises a pair of screw members in the form of screws 12 for screwing one into each end portion of the body 8 to secure the body 8 to the door 2 with the end collar members 10 abutting the door 2 as shown.

The end collar members 10 are slideable along the entire length of the body 8 so that the body 8 can be cut to any desired length to fit any existing handle holes 6 in the door 2 and to have any desired curvature permitted by the flexible material. The end collar members 10 are also a sufficiently tight sliding fit that they act to try and prevent expansion of the end portions of the body 8 as the screws 12 are screwed into position in the end portions of the body 8 so that the end portions become firmly sandwiched between the collar members 10 and the screws 12.

The body 8 has a bore 14 which is of a diameter which enables the screws 12 to bite into the flexible material as the screws 12 are screwed into position. The bore 14 is also of a uniform diameter along its length so that the screws 12 can be screwed into the end portions of the body 8 irrespective of where the body 8 may have been cut without the need for enlarging the bore 14.

Referring now to FIGS. 2 and 3, similar parts as in FIG. 1 have been given the same reference numerals for ease of description. FIG. 2 shows a body 8 which is triangular in cross-section and it is fitted with an end collar member 10 which is triangular in plan. FIG. 3 shows a body 8 which is square in cross-section and which is fitted with an end collar member 10 which is square in plan.

Advantageously, the diameter of the shanks 16 of the screws 12 is 2 mm larger than the diameter of the bore 14 of the body 8. Thus, for example, the diameter of the shanks 16 may be 5 mm and the diameter of the bore 14 may be 3 mm. The holes 6 may be 5 mm or a little less. The thickness of the door 2 may be, for example, 10 mm or 15 mm although obviously thinner and thicker doors may be employed.

It is to be appreciated that the embodiments of the invention described above with reference to the drawings have been given by way of example only and that modifications may be effected. Thus, for example, the door 2 can be part of any desired article of furniture. Also, other shapes for the body 8 and the end collar members 10 can be employed. The screws 12 could be replaced by bolts. Also, the body portion 8 could be ribbed on its outer surface but it is preferably plain as shown.

We claim:

1. An article of furniture comprising a door and/or a drawer which are openable and closeable by a handle, the handle comprising a hollow elongate body made of a flexible material, a pair of end collar members which are a sliding fit one over each end portion of the body, and a pair of screw members for screwing one into each end portion of the body to secure the body to the door or the drawer with the end collar members abutting the door or the drawer, the end collar members being slideable along the entire length of the body so that the body can be cut to any desired length to fit any existing handle holes in the door or the drawer and to have any desired curvature permitted by the flexible material, the end collar members being a sufficiently tight sliding fit that they act to try and prevent outward expansion of the end portions of the body as the screw members are screwed into position in the end portions of the body so that the end portions become firmly sandwiched between the collar members and the screw members, and the body having a bore which is of a size that enables the screw members to bite into the flexible material as the screw members are screwed into position and which is of a uniform size along its length so that the screw members can be screwed into the end portions of the body irrespective of where the body may have been cut without the need for bore enlargement to receive the screw members.

2. An article of furniture according to claim 1 in which the flexible material is a plastics material.

3. An article of furniture according to claim 2 in which the body is of circular cross-section.

4. An article of furniture according to claim 3 in which the body has a smooth outer surface.

5. An article of furniture according to claim 2 in which the end collar members are provided with a tapered bore with the leading end of the bore being the largest end, the tapered bore facilitating the positioning of the collars over the body of the handle and also facilitating starting of the screwing of the screw members into the bore of the body because the body will not be trapped quite so tightly by the collar members where the collar bore is slightly enlarged.

6. An article of furniture according to claim 5 in which the end collar members are made of a plastics material.

7. An article of furniture according to claim 6 in which the end collar members are made more rigid than the body.

8. An article of furniture according to claim 7 in which the end collar members are circular in plan.

9. An article of furniture according to claim 8 and in which the handle includes a pair of washers, one for each screw member.

* * * * *